United States Patent [19]

Letcher

[11] 4,428,036

[45] Jan. 24, 1984

[54] LIGHT FITTINGS

[76] Inventor: Philip W. Letcher, 6 Second Ave., Auckland, New Zealand

[21] Appl. No.: 443,522

[22] Filed: Nov. 22, 1982

[30] Foreign Application Priority Data

Apr. 14, 1982 [NZ] New Zealand ..... 200299

[51] Int. Cl.[3] ..... F21M 1/00

[52] U.S. Cl. ..... 362/257; 362/296; 362/317; 362/341; 362/347; 362/348; 362/375; 362/806

[58] Field of Search ..... 362/257, 296, 317, 341, 362/347, 348, 375, 806

[56] References Cited

U.S. PATENT DOCUMENTS

| | | | |
|---|---|---|---|
| 114,140 | 4/1871 | Hobbs et al. | 362/351 |
| 275,641 | 4/1883 | Gordon | 362/361 |
| 2,702,850 | 2/1955 | Harling | 362/361 |
| 4,197,574 | 4/1980 | Weiss | 362/362 |

*Primary Examiner*—Stephen J. Lechert, Jr.
*Attorney, Agent, or Firm*—Holman & Stern

[57] ABSTRACT

This invention relates to light fittings and in particular to a light fitting including a shade or surround in association with a source of light.

2 Claims, 2 Drawing Figures

LIGHT FITTINGS

DESCRIPTION OF THE PRIOR ART

Up until this time numerous light fittings have been provided including one or more sources of light such as for example electrical bulbs, tubes and the like associated with surrounds or shades, which have shaded and at least partially covered the light, and which also serve to diffuse the light in various directions. Such shades and surrounds are usually adapted to have a particular aesthetic appeal.

For example, up until this time shades have been in various materials such as for example various colored plastic materials, bakelite (registered trade mark) and the like. Also shades of glass have been used.

BRIEF SUMMARY OF THE INVENTION

It has now been determined that by using a shade or surround of a rough cast (as defined hereinafter) earthenware ceramic material, a particularly effective, acceptable and aesthetically pleasing shade or surround is provided.

It has been found that such shades or surrounds can be tinted with one or more colors, during formation and it has also been found that by having at least the interior of the shade or surround of a substantially rough cast (as defined hereinafter) formation, light from the source of light partially covered by the shade or at least partially enclosed by a surround, is caused to be diffused by the rough cast earthenware ceramic material, to be diffused in a particularly acceptable and aesthetically pleasing manner.

Such arrangements also have the advantage that they are relatively inexpensive to manufacture, in that such earthenware ceramic or pottery articles can be made from a number of sources and to a number of sizes, shapes and colors, depending upon the desires of the user or manufacturer.

It should be appreciated that earthenware ceramic material is defined as an earthenware, clay or pottery material.

In use such arrangements are found to be particularly aesthetically pleasing and practical.

It is an object of this invention to provide a straight forward and efficient light fitting.

Other objects of the invention will become apparent from the following description.

Throughout the specification and claims, reference is made to the term "rough cast surface" and this is defined as being a surface which has not been fully treated to provide a smooth, reflective surface, but a surface which is a substantially natural earthenware ceramic surface, usually having an at least slight rough or irregular appearance and feel.

According to one aspect of this invention there is provided a light fitting including at least one source of light and an earthenware ceramic shade or surround formed of an earthenware ceramic material, the surround at least partially surrounding and enclosing said at least one source of light the material on at least the inside of said shade or surround being tinted with one or more colors and having a substantially rough cast surface (as defined herein).

According to a further aspect of this invention, there is provided a light fitting including at least one source of light and a shade or surround formed of an earthenware ceramic material, tinted with one or more colors on at least an inner surface thereof, the shade or surround being substantially elongate and cylindrical in formation, and additionally being at least partially open at one end thereof to enable location of and attachment to a source of light or fitting, the other end of said shade or surround being open, such that the shade or surround thereby at least partially surrounds and encloses said at least one source of light, and at least the inside surface of said shade or surround having a substantially rough-cast surface (as herein defined).

DESCRIPTION OF THE DRAWINGS

The invention will now be described by way of example only and with reference to the accompany drawings wherein.

DETAILED DESCRIPTION OF THE PREFERRED EMBODIMENT

It is preferred that the invention be used in connection with electric lights, and in connection with electrical bulbs and fluorescent tubes. This is by way of example only however.

The shade or surround of the invention can be provided of any particular shape and configuration, such as for example a substantially truncated lamp shade, or a rounded lamp shade, or a shade of any shape and configuration. Alternatively, the surround can be a substantially cylindrical or tubular elongate member which substantially encloses a source of light (which may be a light bulb). An at least partial opening is provided at one end to enable location of the light bulb, and attachment of the shade and light bulb to a flex or cord, (or to some suitable mounting or attachment) so as to enable for example the fitting to be attached to a wall or desired surface. Such fittings will have an open or substantially open lower end so as to enable light to pass out of the shade and to be diffused from said shade or surround.

In this form of the invention outer surfaces of the shade or surround can if desired by coated with surface coatings or the like so as to enable them to have a substantially glazed appearance, but it is important that at least the inside of the shade or surround has an inner surface which is substantially rough cast.

The earthenware ceramic material from which the shade or surround is made can be tinted with one or more colors, during formation, depending upon the desire of the user or manufacturer.

In use, on a shade or surround of the present invention being connected to a source of electrical power, and being mounted relative to or about a source of light, and on the light being turned on, the light will be diffused by the rough cast surface of the inside surface of the shade or surround. This earthenware ceramic rough cast inner surface will cause the light to be diffused and aesthetically pleasing. If desired, and as mentioned hereinbefore, the earthenware ceramic material can be tinted one or more colours to give a coloured effect to the light being diffused by the shade or surround.

It has been found that the use of such an earthenware ceramic shade or surround is particularly advantageous from a cost point of view, from a manufacturing point of view and from an aesthetic and use point of view.

Figure 2:
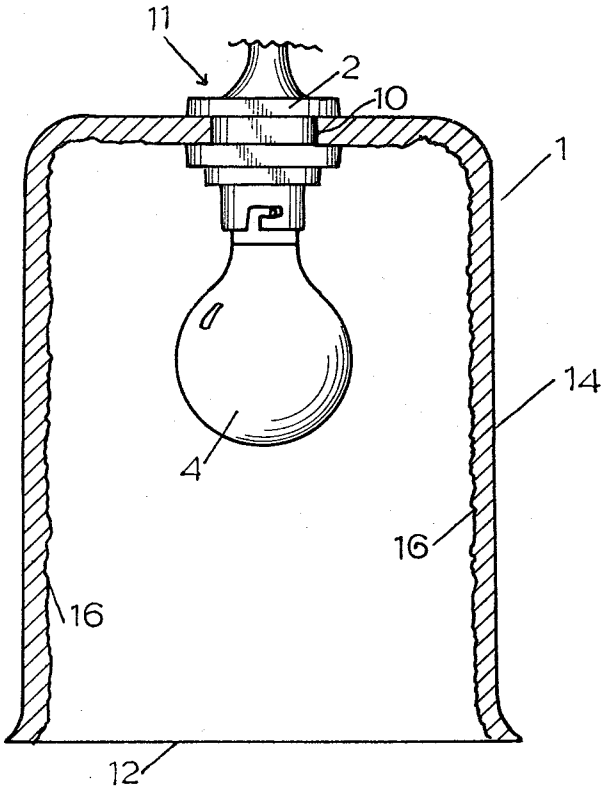
FIG. 2 is a cross-sectional view of the light fitting according to FIG. 1.
Figure 1:
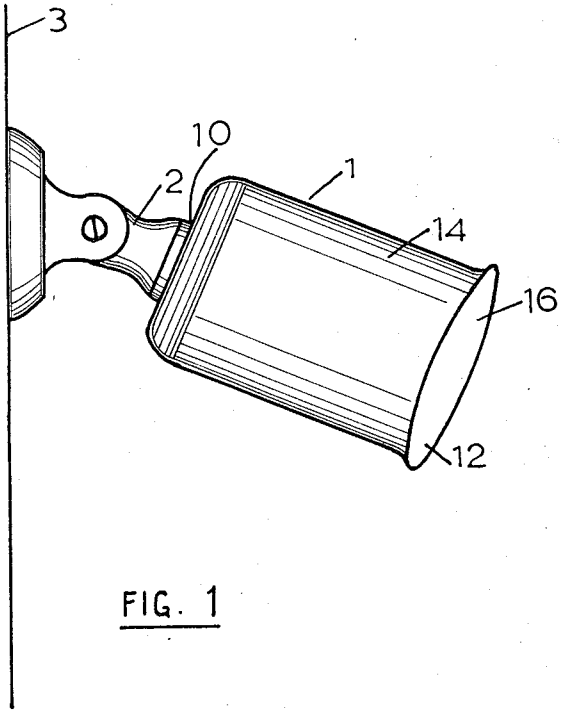
FIG. 1 is a side elevational view of a mounted light fitting according to one form of the invention.

Referring now to FIGS. 1 and 2 of the accompanying drawings, it will be seen that the shade 1 is provided which is formed with an attachment 2 to enable the shade 1 to be attached to a wall 3, so that the position of the light can be adjusted relative to the wall.

One or more light bulbs 4 as normally available in commerce is used, although some other form of light can be provided if desired.

The shade or surround 1 is a substantially elongate cylindrical member formed of an earthenware ceramic material and having at an upper end a hole 10 through which an attachment 2 can pass, a suitable clip being provided or some suitable glue or bonding means being provided to enable the fitting 2 to be secured relative to the upper end 11 of the shade or surround 1.

The lower end 12 of the shade or surround 1 is open.

The outer surface 14 of the surround 1 can if desired be rough cast or alternatively can be covered with some suitable surface coating so as to give a substantially glazed appearance depending upon the desire of the user.

The inside surface 16 of the surround 1 has a rough cast surface.

The surround 1 when being formed can be tinted with one or more colors, so that these will be apparent in the rough cast surface of the inside 16 of the surround 1. Thus on the light being turned on, the rough cast surface 16 on the inside of the surround 1 causes the light from the bulb(s) 4 to be diffused and the tinted nature of the earthenware ceramic surround will have the effect of coloring or tinting any light being diffused from the surround 1.

It should be appreciated that such a surround 1 can be of any shape and configuration and can be used with any other form of fitting or attachment, so as to enable it to be attached to a source of light, so that the light is provided at least partially within, and is at least partially surrounded by, the shade or surround 1.

This invention has been described by way of example only and it should be appreciated that improvements and modifications may be made without departing from the scope of the claims appended hereto.

I claim

1. A light fitting comprising at least one source of light and a shade or surround formed of earthenware ceramic material at least partially surrounding and enclosing said at least one source of light, said material on at least the inside of said shade or surround being tinted with one or more colors and having a substantially rough cast surface.

2. A light fitting comprising at least one source of light, a substantially elongate and hollow cylindrical shade, or surround, formed of an earthenware ceramic material and tinted with one or more colors on at least an inner surface thereof, an opening through one end of said shade, said source of light being attached to said shade at said opening, the other end of said shade being substantially fully open, so that the shade at least partially surrounds and encloses said at least one source of light, and at least the inside surface of said shade having a substantially roughcast surface.

* * * * *